US005829749A

United States Patent [19]

Hobert

[11] Patent Number: 5,829,749

[45] Date of Patent: Nov. 3, 1998

[54] METHOD OF PLAYING A CRAPS GAME WITH A JACKPOT WAGER

[76] Inventor: Marcus V. Hobert, 3318 Kenwood Ave., Davenport, Iowa 52807

[21] Appl. No.: 588,076

[22] Filed: Jan. 17, 1996

Related U.S. Application Data

[63] Continuation-in-part of Ser. No. 305,178, Sep. 13, 1994, Pat. No. 5,487,547, Ser. No. 389,537, Feb. 16, 1995, Pat. No. 5,490,670, and Ser. No. 527,274, Sep. 12, 1995, Pat. No. 5,785,596, and a continuation-in-part of Ser. No. 556,254, Nov. 13, 1995, Pat. No. 5,728,002.

[51] Int. Cl.[6] ..... A63F 9/04

[52] U.S. Cl. ..... 273/274; 463/17; 463/26

[58] Field of Search ..... 273/274, 309, 273/146; 463/22, 26, 17

[56] References Cited

U.S. PATENT DOCUMENTS

| | | | |
|---|---|---|---|
| 3,399,897 | 9/1968 | Mitchell | 273/274 |
| 3,904,208 | 9/1975 | Grossman | 273/146 |
| 4,334,685 | 6/1982 | Robbins et al. | 273/274 |
| 4,688,803 | 8/1987 | Ollington | 273/274 |
| 4,900,034 | 2/1990 | Bereuter | 273/274 |
| 4,902,019 | 2/1990 | Berman | 273/256 |
| 5,133,559 | 7/1992 | Page | 273/274 |
| 5,263,715 | 11/1993 | Mutsumoto et al. | 463/22 |
| 5,308,081 | 5/1994 | Bartle | 273/274 |
| 5,350,175 | 9/1994 | DiLullo et al. | 273/274 |

OTHER PUBLICATIONS

Scarne's Complete Guide To Gambling by John Scarne, pp. 257–267, Simon and Schuster, 1961.

*Primary Examiner*—Benjamin H. Layno
*Attorney, Agent, or Firm*—McAndrews, Held & Malloy, Ltd.

[57] ABSTRACT

A method of playing a craps game is disclosed that incorporates a jackpot wagering area in a traditional craps game. The method includes receiving a bet that a jackpot sequence of dice outcomes will be rolled. The jackpot sequence has a relatively remote possibility of occurrence and, correspondingly, a high payoff. A jackpot wagering area bet may cover wagers in addition to the jackpot sequence wager. For example, the bet may also cover an additional jackpot sequence wager, a lower payoff sequence wager, or a traditional craps wager. Also, the method of playing a craps game with a jackpot sequence wager may be played on a video screen.

48 Claims, 4 Drawing Sheets

METHOD OF PLAYING A CRAPS GAME WITH A JACKPOT WAGER

CROSS-REFERENCE TO RELATED APPLICATION

The present application is a continuation-in-part of four pending patent applications of Marcus V. Hobert: (1) Ser. No. 305,178, now U.S. Pat. No. 5,487,547 filed on Sep. 13, 1994 to be issued on Jan. 30, 1996; (2) U.S. Ser. No. 08/389,537 (Attorney Docket No. 10433US02) filed Feb. 16, 1995, now U.S. Pat. No. 5,490,670; (3) U.S. Ser. No. 08/527,274 (Attorney Docket No. 10433US04) filed Sep. 12, 1995, now U.S. Pat. No. 5,785,596; and (4) a continuation-in-part application U.S. Ser. No. 08/556,254 (Attorney Docket No. 10433US03) filed Nov. 3, 1995, now U.S. Pat. No. 5,728,002. The entire disclosure of these applications including the drawings and appendices are incorporated herein by reference as if set forth fully in this application.

FIELD OF THE INVENTION

The present invention relates to a method of playing craps that includes a jackpot wager.

BACKGROUND OF THE INVENTION

The game of craps is a popular casino game. The allure of dice games dates to ancient times. Today, most casinos provide craps tables for the entertainment and enjoyment of their guests.

Craps players enjoy the game for many reasons. First, unlike many other casino games, a craps player controls the random outcome of the game. One player, commonly called the "shooter," rolls a pair of dice to determine if particular bets are won or lost. Each craps player in turn may take control of the game by rolling the dice. Despite the random outcome of the dice rolls, players enjoy actively participating in the randomly determined outcome of the craps game. In contrast, in games such as roulette, blackjack, slots, and video poker, the casino or a machine controls devices that determine the outcome of the game.

In addition, craps players enjoy the camaraderie and fellowship of the game. At the craps table, many players place the same bets on particular rolls or combination of rolls of the dice. For example, most players place a bet on the "pass line." Then, all bets are individually won or lost based on the same dice rolls. Accordingly, although each player's bets and payoffs are distinct, most players at a single craps table share a common interest in particular outcomes of the dice.

At the craps table, most players' fortunes rise and fall with the shooter. Although a minority of players bet against the shooter, most players win when the shooter throws a winning roll. Accordingly, due to the common good fortune, the players often cheer, slap hands, congratulate each other, and proclaim the perceived prowess of the shooter. This group celebration contributes to the excitement of the game of craps.

Also, experienced craps players enjoy the variety and complexity of possible bets in a craps game. A craps table includes a wide variety of possible bets. For example, a player may bet that an 11 will be rolled on the next roll of the dice by throwing in a chip and declaring "Yo Eleven." A player may bet that a 6 will be rolled before a 7 by throwing in a chip and declaring "Place the 6." Also, on the "pass line" or "come line," a player may make a bet with multiple opportunities for winning and the possible option of increasing the bet.

In addition, the payoffs on bets vary widely depending on the odds of certain dice outcomes. Further, a player may maximize the payoff on a particular bet by betting a particular dollar amount. For example, when making a place bet on the 6 (betting that a 6 will be rolled before a 7), a bet that generally pays 7 to 6 odds on a winning roll, a player obtains better odds by betting in increments of six rather than the customary five. To even further complicate a craps players' choices, the casino's percent advantage, or "vigorish," varies for different bets.

As can be seen, the possible bets and payoffs in a craps game are varied and often complex. This variety and complexity of bets further contributes to the excitement of the game for experienced craps players.

Finally, a craps game is played at a fast pace. Obviously, players must make all bets before the outcome of a dice roll is known. Casinos encourage players to quickly make bets between dice rolls so that the dice may be given to a shooter to start or resume play.

Thus, the opportunity to actively participate in the game, the commonality of interest in dice outcomes, the variety and complexity of bets, and the fast pace of the game make craps a challenging and exciting game.

However, many potential craps players are not attracted to the game. Many are intimidated by the fast pace of the game, the complexity of the potential bets, and the loud and boisterous atmosphere around the craps table. However, casinos seek to increase the number of craps players at their tables. Many casinos offer free craps lessons to prospective players. Also, many casinos provide free in-room videos to their hotel guests that teach the game of craps. Despite these efforts, many potential craps players are timid and do not approach the craps table. However, if these potential players could be enticed to play and learn the game of craps, they could become regular craps players.

In addition, casinos compete for the seasoned craps players. This competition takes many forms. For example, many casinos attempt to create a magnificent fantasy environment for their guests. Also, many casinos provide free lodging, food, and/or admission to specifically identified guests. Finally, at the craps table, casinos often decrease their percent advantage, or "vigorish," to attract craps players.

Seasoned craps players understand the odds of most bets. These players tend to place bets on outcomes that offer the casinos the least advantage. In addition, seasoned craps players gravitate to casinos that offer craps tables with advantageous wagering opportunities. These advantageous wagering opportunities, however, decrease the advantage to the host casino.

Many casinos do not wish to sacrifice their percent advantage on craps wagers to attract seasoned craps players. Also, the market quickly becomes saturated with magnificent fantasy environments and incentives to guests. However, casinos seek to attract new players to the craps table and to attract seasoned players from other casinos.

Most everyone longs to "hit the jackpot." People dream of the day when a large amount of money might suddenly come into their life. People fantasize about purchasing a new home, starting a business, sending their children to college, or taking a special vacation. In pursuit of this dream, people enter lotteries, sweepstakes, and play certain casino games. Although the dream may never come true, these games provide entertainment and allow people to dream.

Accordingly, casinos often offer jackpots or large payoff opportunities in connection with certain casino games. For example, slot machines often offer the opportunity to win a large amount of money on a relatively small wager. Casinos market this opportunity to attract people to the casino to play their slot machines. Once attracted to the casino, the slot machine player often also plays other games, makes purchases at the casino, or stays at the casino hotel.

Despite the appeal of jackpots and large payoff opportunities, casinos have traditionally not included large jackpots in the game of craps. Most commonly, the highest payoff in a craps game is 30 to 1. These odds are generally insufficient to attract new players to the game of craps.

In U.S. Pat. No. 4,902,019, Berman discloses a jackpot opportunity in a craps game. In Berman's craps game, the casino pays a jackpot when the shooter bounces a die off a wall and lands it inside a geometric shape embossed on the craps table. This game was not well received. First, the craps game would become a carnival game of skill testing the shooter's skill at bouncing a die on a table. Second, the jackpot condition, landing the die inside the shape, was unrelated to traditional craps wagers.

In some other prior art dice games that offer a large payoff for a relatively low wager, the game is not craps. Seasoned craps players expect a recognizable craps game layout with familiar craps wagers. Seasoned craps players will not roll dice simply because a large jackpot is possible. Craps players want to play craps. If the traditional craps game is not included with the possibility of a jackpot, many craps players will not play the game. Also, most casino guests are attracted only to the traditional casino games.

When providing the opportunity to win a large jackpot, casinos have found that players enjoy the simultaneous opportunity of winning a smaller payoff. Most slot machines, for example, offer both large jackpots and smaller payoff opportunities on the same bet. When placing a bet in a slot machine, a player might have the opportunity of winning a small payoff of two to three times the amount wagered, a medium payoff of ten to fifty times the amount wagered, or a large jackpot of one hundred, one thousand, ten thousand, or more times the amount wagered. Players enjoy this range of opportunity.

The odds of winning a particular payoff on a given bet are inversely related to the amount that may be won. Large jackpots are won very infrequently, lower payoffs are won more frequently. Although the payoffs are lower, players win more frequently and have a higher expectation of winning on any given bet. The lower payoffs allow players to play the game longer in hopes of winning a large jackpot. Therefore, the simultaneous opportunity of winning either a large jackpot or a smaller payoff increases the entertainment value of the game.

In addition, when offering the possibility of inning a large jackpot, casinos may attract players by promoting and displaying the large possible jackpot. A jackpot display adds to the excitement of a game and contributes to the exciting atmosphere in a casino. For a progressive jackpot, the jackpot will grow larger and larger until it is won. Players may track this growth on the display. As the jackpot grows, player excitement builds, usually resulting in increased play of the game and increased excitement in the casino.

Casinos have also found that players enjoy traditional casino games played on a computer controlled video screen. Casinos offer traditional games such as blackjack, draw poker, slots, keno, and other games in a video format. Players also enjoy these and other casino games, including craps, on personal home computers and hand-held computer games. These video games, however, have not offered the possibility of winning a large jackpot while playing a craps game.

Accordingly, it is an object of the present invention to provide a method of playing a craps game that attracts new players to the game but retains the elements of a traditional craps game.

Another object of the present invention is to provide a method of playing a craps game wherein a jackpot may be won in the craps game.

A further object of the present invention is to provide a method of playing a craps game wherein multiple wagers, including at least one jackpot, may be won on a single bet.

Yet another object of the present invention is to provide a method of playing a craps game wherein a jackpot and a smaller payoff may be won on a single bet.

An additional object of the present invention is to provide a craps game wherein a jackpot may also be won when making a traditional craps wager.

Finally, an object of the present invention is to provide a craps game played on a video screen wherein a jackpot may be won in the craps game.

SUMMARY OF THE INVENTION

One aspect of the present invention is a method of playing a craps game that includes paying a jackpot sequence wager if it is won. In the craps game, a jackpot wagering area is provided that receives a jackpot sequence wager that a jackpot sequence of dice outcomes having a relatively remote probability of occurrence will be rolled.

The jackpot wagering area may also receive bets on multiple wagers such as, for example, one or more additional jackpot sequence wagers, one or more low payoff sequence wagers, or one or more traditional craps wager.

Another aspect of the present invention is a method of playing a craps game on a video screen.

The craps game includes a jackpot sequence wager. The present invention offers many advantages.

The present invention incorporates a jackpot into a traditional craps game. The jackpot will entice new craps players to play the craps game but will not deter experienced players that seek a traditional craps game. Also, the present invention offers players the opportunity to win multiple wagers, including at least one jackpot wager, on a single bet. In one embodiment, players may win multiple jackpot wagers on a single bet. In another embodiment, players may win more frequent lower payoff wagers while attempting to win the infrequent high payoff jackpot wagers. In a further embodiment, players may win a jackpot wager when betting on a traditional craps wager. These multiple opportunities to win will increase the entertainment value of a single wager, encourage wagering at the craps table, and generate excitement in the craps game. Finally, the craps game of the present invention may be played on a video screen.

These and other advantages will become apparent as the following specification is read in conjunction with the accompanying drawings and appended claims.

Figure 1:
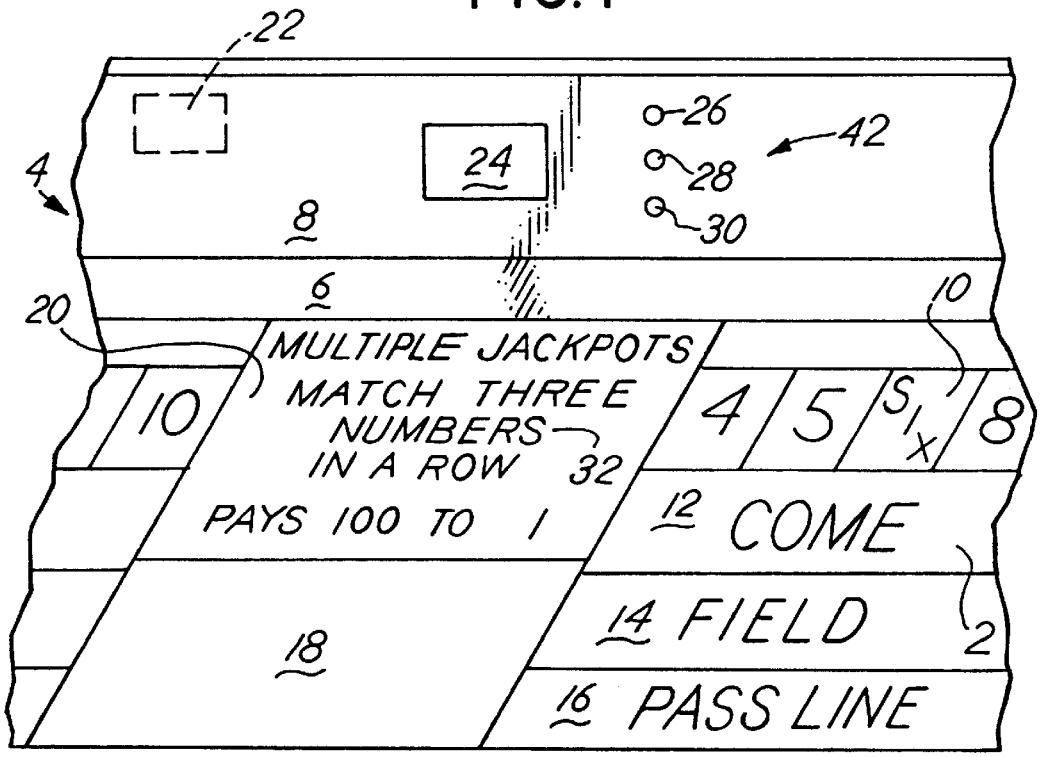
FIG. 1 is a perspective view of a craps table with a jackpot wagering area that provides multiple, consecutive jackpot sequence wagers. The craps table also includes a display area for showing players' progress toward winning the jackpot sequence wager and a number to be rolled to progress toward winning the jackpot sequence wager.

In the Figures, the following reference characters are used:

1 video screen
2 craps game layout
3 dice
4 craps table
6 surface
8 wall
10 place numbers
12 come line
14 the field
16 pass line
18 proposition bets area
20 jackpot wagering area
22 computer
24 display
26 first match indicator
28 second match indicator
30 third match indicator
32 jackpot sequence wager
34 lower payoff sequence wager
36 fourth match indicator
38 fifth match indicator
40 sixth match indicator
42 display area
44 jackpot display
46 seventh match indicator
48 eighth match indicator
50 first jackpot sequence wager
52 second jackpot sequence wager
54 third jackpot sequence wager
56 traditional craps wagering area
58 traditional craps wager
60 multiple indicators

DETAILED DESCRIPTION OF THE INVENTION

Although the invention is described in connection with one or more preferred embodiments, the invention is not limited to those embodiments. The invention includes alternatives, modifications, and equivalents that are included in the spirit and scope of the appended claims.

Figure 1A:
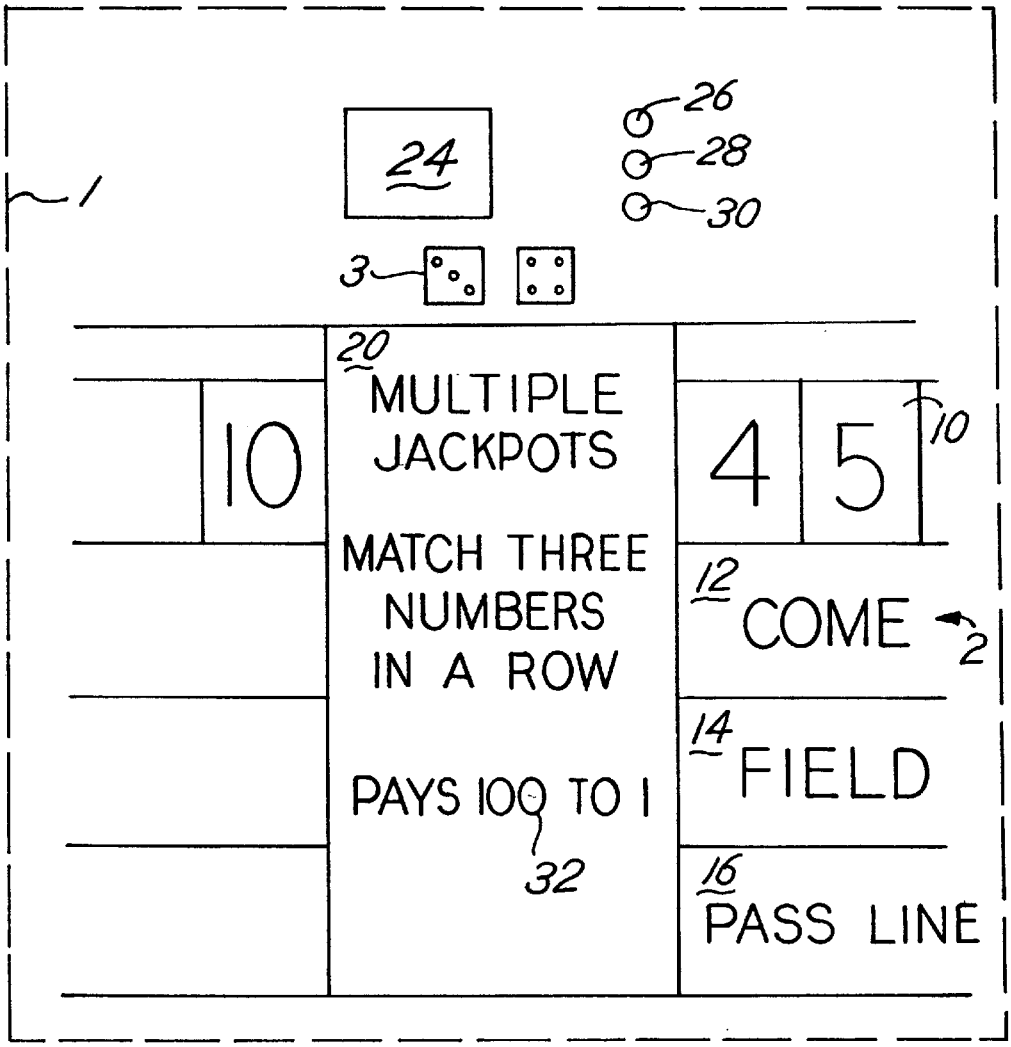
FIG. 1A is a view of a craps game layout and simulated dice as they could appear on a video screen.

FIG. 1 shows one embodiment of the craps game of the present invention. The craps game may be played on a conventional craps table 4, having a surface 6 and a wall 8. Alternatively, the craps game of the present invention may be played on a video screen 1 with simulated dice 3, as shown in FIG. 1A.

The surface 6 of the craps table 4 includes the craps game layout 2. The craps game layout 2 includes several of the traditional craps wagering areas, including the place numbers 10, the come line 12, the field 14, the pass line 16, and the proposition bets area 18. However, the craps game layout 2 also includes a jackpot wagering area 20.

In the jackpot wagering area 20, players may wager that a jackpot sequence of dice outcomes will be rolled. The jackpot sequence has a relatively remote probability of occurrence. Therefore, a casino may offer relatively high odds on the jackpot sequence wager. Accordingly, drawn by a desire to "hit the jackpot," new players will approach the craps table 4 and seasoned craps players will be attracted from casinos lacking a craps game with jackpot opportunities. However, because the craps game layout 2 retains the traditional craps wagering areas, the game retains all of the benefits of the traditional craps game.

As disclosed in my previous patent, U.S. Pat. No. 5,487,547, and application Ser. No. 08/389,537, incorporated by reference, the jackpot sequence may be a variety of dice outcomes having a relatively remote probability of occurrence. Also, the jackpot sequence may be predetermined or randomly generated. To increase the appeal of the craps game, the jackpot wagering area 20 allows multiple jackpot area wagers on a single bet.

As used herein, the jackpot wagering area 20 is the space for receiving bets. Preferably, the jackpot wagering area 20 is on the craps layout 2. However, the jackpot wagering area may be separated from the craps game layout 2 and the craps table 4 without deviating from the scope of the invention. Also, the craps layout may be displayed on a video screen and incorporate the jackpot wagering area on the screen.

The jackpot area wagers are the wagers that may be won by making a bet on the jackpot wagering area 20. In FIGS. 1, 2, 3, 5, and 7, the indicia in the jackpot wagering area 20 describes the jackpot area wagers. The indicia describing the jackpot area wagers may also be placed outside the jackpot wagering area 20. For example, the jackpot area wagers may be described on the wall of the craps table 4 or on any other surface readable by the craps players. Regardless, the jackpot wagering area 20 is the place where jackpot area wagers are received.

The jackpot area wagers may include, for example, multiple jackpot sequence wagers, one or more jackpot sequence wagers combined with one or more lower payoff sequence wagers, or one or more jackpot sequence wagers combined with one or more traditional craps wagers. The various jackpot area wagers may be predetermined, randomly generated, or partially predetermined and partially randomly generated.

In FIG. 1, the jackpot wagering area 20 provides a randomly determined jackpot sequence wager 32. Before each dice roll, a random number from 2 to 12 is generated by a computer 22 behind the wall 8 of the craps table 4. The random number is displayed on the display 24. If the shooter rolls the number shown on the display 24, the casino or host activates the first match indicator 26. The computer 22 then generates a second number. On the next roll, if the shooter rolls the second number, the host activates the second match indicator 28. The computer 22 then generates a third number. On the next roll, if the shooter rolls the third number, the jackpot sequence has been rolled. The host activates the third match indicator 30 and pays all bets made on the jackpot wagering area 20. The winning bets remain on the jackpot wagering area 20 and are eligible for the next jackpot sequence. For the next jackpot sequence, the payoff may remain the same.

If the shooter fails to match the required number at any time, the host deactivates any activated indicators and the jackpot sequence resets. However, all bets in the jackpot wagering area 20 remain in effect. Accordingly, each bet in the jackpot wagering area 20 is eligible for multiple, consecutive jackpot sequences. The bets are lost when the shooter ends his or her turn by "crapping out."

Alternatively, the jackpot sequence may consist of more or less than three numbers. Also, the jackpot sequence may be predetermined, rather than randomly generated. In that case, the same predetermined jackpot sequence is played repetitively. In addition, the numbers may be randomly generated by a die, multiple dice, dice in an enclosure, such as a cage, that rolls the dice, a spinning, segmented wheel, or other mechanical means. Further, rather than three different numbers, the host may define the jackpot using a single randomly generated number that must be matched three times in a row.

Although FIG. 1 shows a payoff of 100 to 1 in the jackpot wagering area 20, the host may set the odds at another amount. Alternatively, instead of displaying the odds on the craps game layout 2, the computer 22 may generate the odds and display the odds on the display 24. If the computer 22 calculates and displays the odds, the odds may be varied based on the numbers to be matched. In particular, if the same number must be matched three times in a row, the computer 22 could display the odds for the particular sequence of numbers. In this way, the host may offer a higher payoff on the jackpot sequences that have a lower probability of being rolled, such as three 11's in row. Correspondingly, the host may decrease the payoff on the jackpot sequences that have a relatively higher probability of being rolled, such as three 6's in a row.

Figure 2:
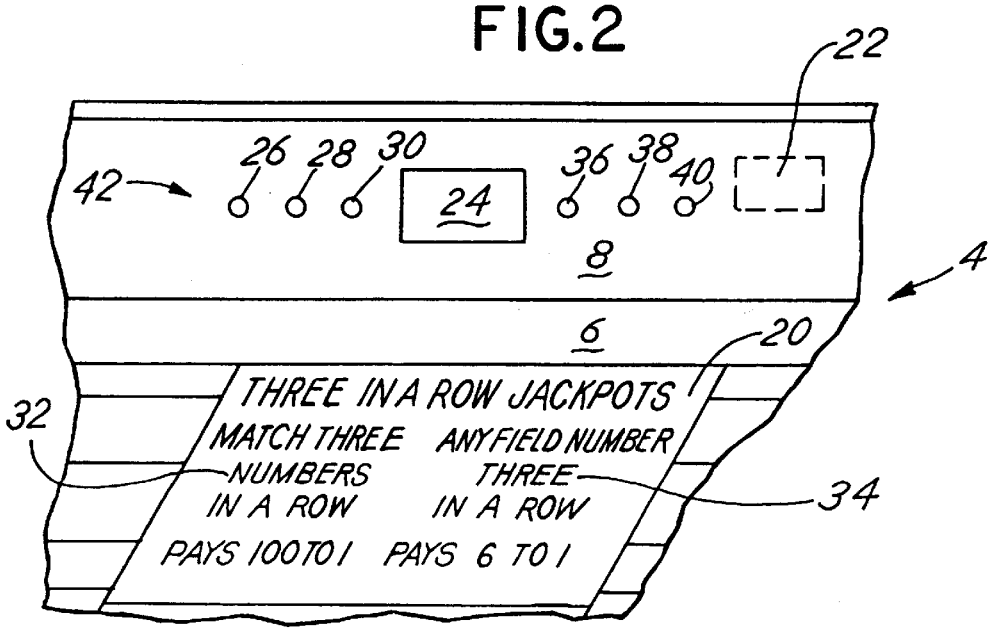
FIG. 2 is a perspective view of a craps table with a jackpot wagering area that provides a jackpot sequence wager and a lower payoff sequence wager that are played concurrently. The craps table also includes a display area for showing players' progress toward winning the jackpot sequence wager and the lower payoff sequence wager and a number to be rolled to progress toward winning the jackpot sequence wager.

FIG. 2 shows another embodiment of the craps game of the present invention. In FIG. 2, the jackpot wagering area 20 provides a jackpot sequence wager 32 and a lower payoff sequence wager 34 that are played concurrently.

The jackpot sequence wager 32 is identical to the wager described in reference to FIG. 1. The computer 22 generates a random number that is displayed on the display 24. The progress of the jackpot sequence is tracked by the match indicators 26, 28, and 30. However, bets made on the jackpot wagering area 20 are also eligible to win a lower payoff sequence wager 34.

The lower payoff sequence wager 34 is won when the shooter rolls any of the field numbers (2, 3, 4, 9, 10, 11, 12) three times in a row. Like the jackpot sequence, the lower payoff sequence is tracked by three match indicators 36, 38, and 40. If the shooter rolls three field numbers in a row, the host pays all bets made on the jackpot wagering area 20. The winning bets remain on the jackpot wagering area 20 and remain eligible for the jackpot sequence and the next lower payoff sequence. Similarly, if the jackpot sequence wager 32 is won, as described above, the winning bets remain on the jackpot wagering area 20 and remain eligible for the lower payoff sequence and the next jackpot sequence.

If the shooter fails to roll a field number at any time, the host deactivates any activated indicators and the lower payoff sequence resets. However, all bets in the jackpot wagering area 20 remain in effect. Accordingly, each bet on the jackpot wagering area 20 is eligible for concurrent, multiple, and consecutive jackpot area sequences. The bets are lost when the shooter ends his or her turn by "crapping out."

Alternatively, the lower payoff sequence may consist of any sequence of dice outcomes having a probability of occurrence relatively higher than the remote probability of occurrence of the jackpot sequence. Also, the lower payoff sequence may consist of more or less than three numbers. Of course, the host may lower the payoff on the lower payoff sequence to recognize its higher probability of occurrence. Finally, the jackpot sequence may be predetermined, rather than randomly generated.

The concurrent jackpot sequence wager 32 and lower payoff sequence wager 34 increases the entertainment value of making a bet on the jackpot wagering area 20. The jackpot sequence wager 32 will be won infrequently. However, the lower payoff sequence wager 34 will be won more frequently and will increase player interest in the jackpot wagering area 20. Players will have a higher expectation of winning on the jackpot wagering area 20 and will be positively reinforced by the more frequent lower payoffs.

Figure 3:
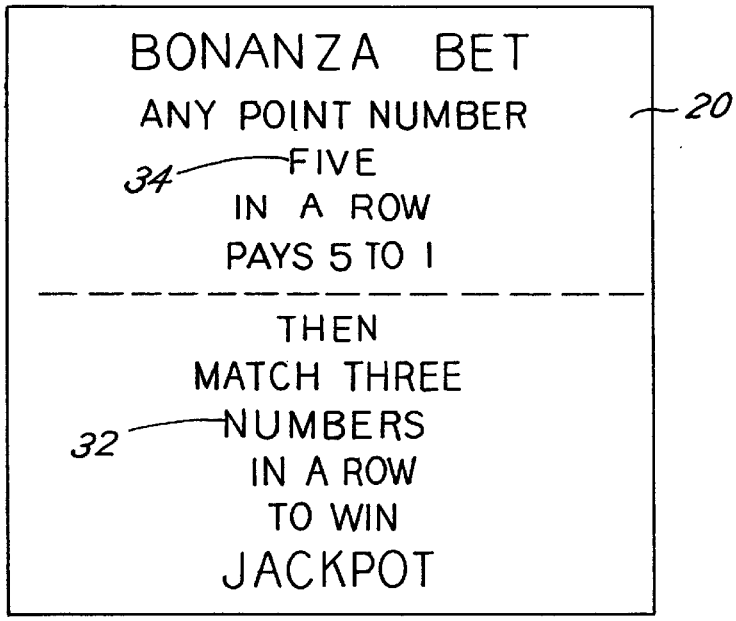
FIG. 3 is a top plan view of a jackpot wagering area that provides a lower payoff sequence wager and a jackpot sequence wager that are played sequentially.

FIG. 3 shows yet another embodiment of the craps game of the present invention. In FIG. 3, the jackpot wagering area 20 provides a lower payoff sequence wager 34 and a jackpot sequence wager 32 that are played sequentially. To qualify for the jackpot sequence wager 32, a player must first win the lower payoff sequence wager 34.

Figure 4:
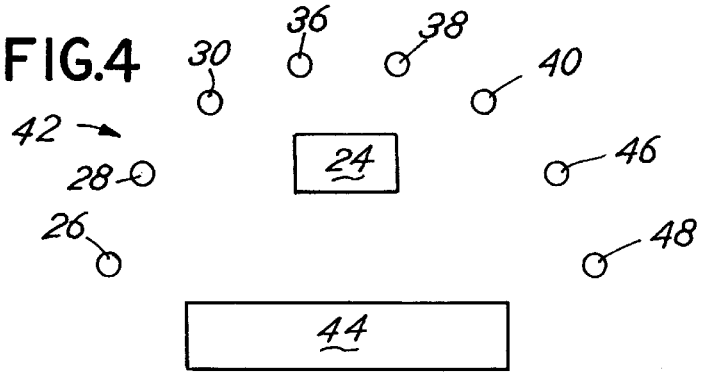
FIG. 4 is a front plan view of a display area for showing players' progress toward winning a lower payoff sequence wager and a jackpot sequence wager, a number to be rolled to progress toward winning the jackpot sequence wager, and a jackpot to be won.

FIG. 4 shows one embodiment of a display area 42 for tracking the sequential wager of FIG. 3. The display area 42 includes a display 24, a jackpot display 44, and eight match indicators 26, 28, 30, 36, 38, 40, 46, and 48. The display area 42 may be placed on the wall 8 of the craps table 4, like the display area 42 in FIGS. 1 and 2, placed on the surface 6 of the craps table 4, placed on a video screen, or placed on any surface in proximity of the craps table so that it is visible to the players. The elements of the display area 42 may be separated and placed on separate surfaces. Also, the display area 42 may be incorporated in a craps game played on a video screen and, accordingly, displayed on the screen.

In the embodiment of FIG. 3, the lower payoff sequence wager 34 is won when the shooter rolls any of the point numbers (4, 5, 6, 8, 9, 10) five times in a row. As shown in FIG. 4, the lower payoff sequence is tracked by the five match indicators 26, 28, 30, 36, 38. If the shooter rolls five point numbers in a row, the host pays all bets made on the jackpot wagering area 20. The winning bets remain on the jackpot wagering area 20 and become eligible for the jackpot sequence wager 32. To win the jackpot sequence wager 32, the shooter must then match the number displayed on the display 24. The jackpot sequence is tracked by three match indicators 40, 46, 48. If the shooter matches the number three times in a row, the jackpot sequence wager 32 is won. Thus, each bet in the jackpot wagering area 20 is eligible for multiple, sequential jackpot area sequences.

As shown in FIG. 4, the payoff for the jackpot sequence wager 32 may be displayed in a jackpot display 44. This payoff may take the form of a progressive jackpot. Because of the low probability of rolling two sequences in a row, the jackpot sequence wager 32 will be won very infrequently. Therefore, based on unsuccessful wagers, the jackpot for the jackpot sequence wager 32 may be allowed to grow progressively at a rate defined by the host. In addition, the jackpot shown in the jackpot display 44 will visibly grow and generate interest and excitement among the players. Also, despite the low probability of winning the progressive jackpot, the lower payoffs from the lower payoff sequence wager 34 will be won relatively frequently and will keep many players interested in the progressive jackpot.

If the shooter fails to roll a required number at any time, the host deactivates any activated indicators and the lower payoff sequence resets. At this point, the host may declare all jackpot area wagers lost and collect all bets on the jackpot wagering area 20. Alternatively, the host may allow all jackpot wagering area 20 bets to remain in effect. Under this alternative, the bets are lost when the shooter ends his or her turn by "crapping out."

Figure 5:
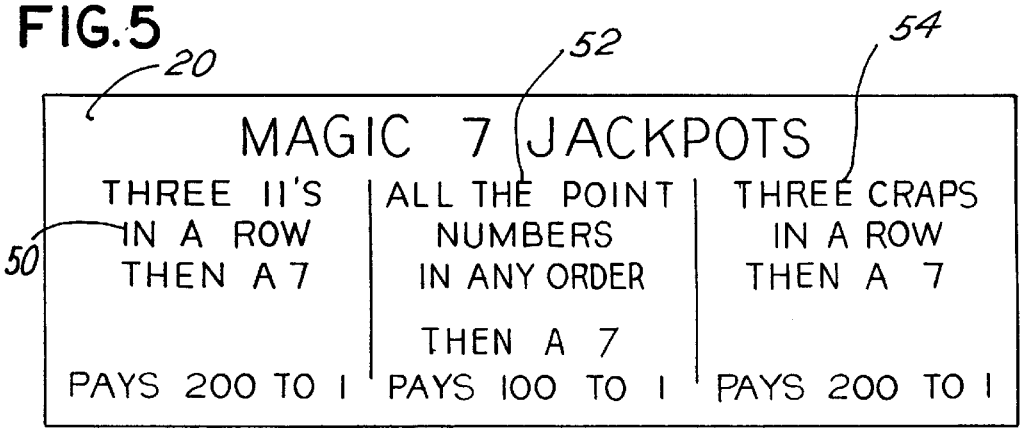
FIG. 5 is a top plan view of a jackpot wagering area that provides multiple, mutually exclusive jackpot sequence wagers.

FIG. 5 shows a further embodiment of the craps game of the present invention. In FIG. 5, the jackpot wagering area 20 provides multiple, predefined, mutually exclusive jackpot sequence wagers 50, 52, and 54. The first jackpot sequence wager 50 is won when the shooter rolls three 11's in a row and then rolls a 7. The second jackpot sequence wager 52 is won when the shooter rolls all the point numbers (4, 5, 6, 8, 9, 10) in any order and then rolls a 7. The third jackpot sequence wager 54 is won when the shooter rolls the three craps numbers (2, 3, 12) in a row and then rolls a 7. The three jackpot sequences may be tracked by indicators, as previously described.

A single wager in the jackpot wagering area 20 covers all three jackpot sequence wagers 50, 52, and 54. However, the three wagers are mutually exclusive. Each requires different numbers to win. Accordingly, a player may win only one of the jackpot sequence wagers on a single wager. Thus, each bet in the jackpot wagering area 20 is eligible for multiple, but mutually exclusive, jackpot area sequences.

If the shooter fails to roll a required number at any time, the jackpot area wagers are lost and the host collects all bets on the jackpot wagering area 20. Alternatively, the host may simply reset any activated indicators and allow all jackpot wagering area bets to remain in effect. Under this alternative, the bets are lost when the shooter ends his or her turn by "crapping out."

Figure 6:
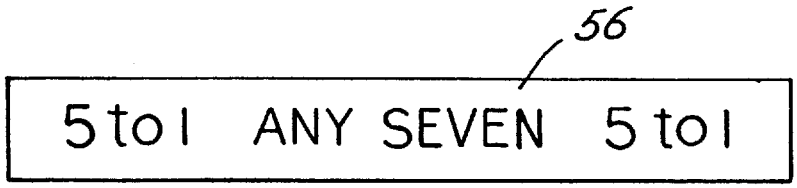
FIG. 6 is a top plan view of a traditional craps wagering area.

FIG. 6 shows a traditional craps wagering area 56. The "Any Seven" wager, commonly found in the proposition bets area 18, allows a player to bet that a 7 will be rolled on the next roll. After a bet is made on the "Any Seven" wagering area, the host pays all bets if the next roll is a 7. If the next roll is not a 7, the host collects all bets on the "Any Seven" wagering area.

Figure 7:
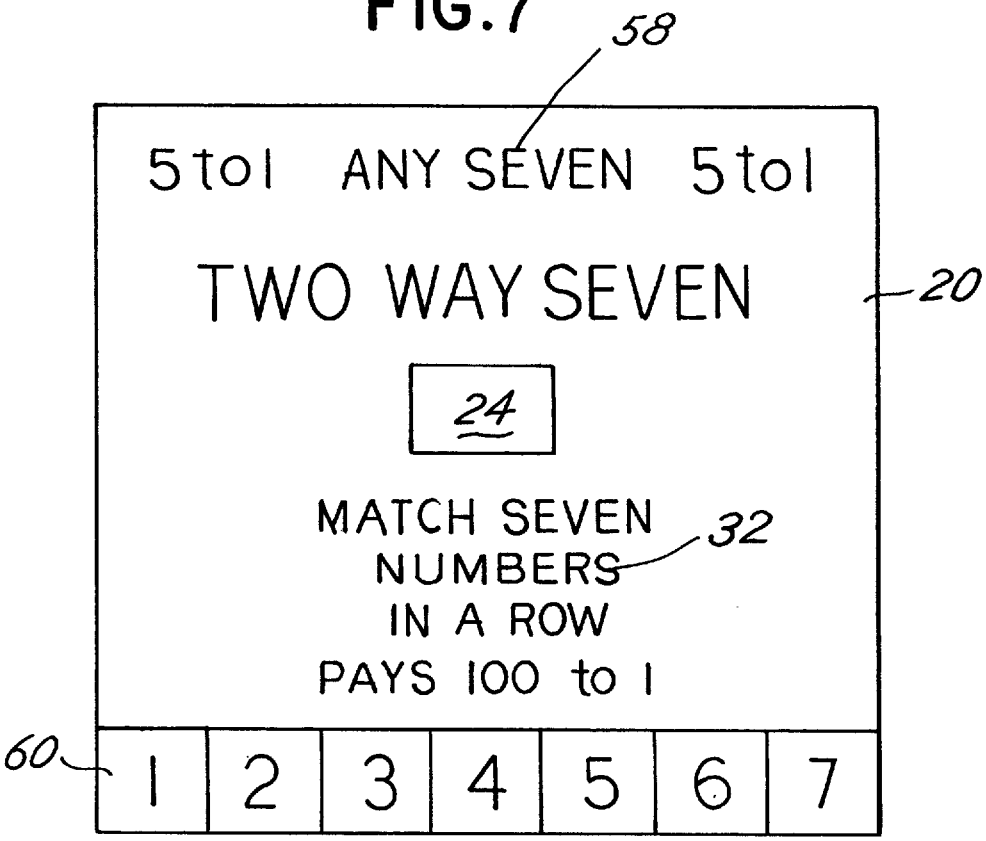
FIG. 7 is a top plan view of a jackpot wagering area that provides a jackpot sequence wager and a traditional craps wager that are played concurrently. The jackpot wagering area also includes a display for showing players' progress toward winning a jackpot sequence wager and a number to be rolled to progress toward winning the jackpot sequence wager.

FIG. 7 shows another embodiment of the present invention. In FIG. 7, the jackpot wagering area 20 provides a traditional craps wager 58 and a jackpot sequence wager 32 that are played concurrently. The traditional craps wager 58 is the "Any Seven" wager and is identical to the wager represented in FIG. 6. However, bets made on the jackpot wagering area 20 are also eligible to win the jackpot sequence wager 32.

After making a bet on the jackpot wagering area of FIG. 7, a player may win the "Any Seven" traditional craps wager 58 if a 7 is rolled on the next roll. If the next roll is not a 7, the player may still qualify for the jackpot sequence. If the roll matches the number on the display 24, the host activates the first of the multiple indicators 60 and any bets on the jackpot wagering area 20 remain in play. If the next six rolls also match the number on the display 24, the host pays all bets made on the jackpot wagering area 20 at the higher jackpot payoff. If the first roll is not a 7 and the shooter fails to match the displayed number at any point, the host deactivates any activated indicators and all bets on the jackpot wagering area 20 are lost.

The display 24 may be included in the craps game layout 2, as shown in FIG. 7. However, as previously described, the display 24 may be placed on many alternative surfaces. Also, the jackpot payoff may be predetermined and displayed on the craps game layout 2. Alternatively, the jackpot payoff may be allowed to grow progressively or may be shown on an alternate surface, as previously described. Also, as previously described, the jackpot sequence may be any sequence of dice outcomes with a relatively remote probability of occurrence. Finally, the traditional craps wager 58 may be other wagers such as, for example, an 11 proposition bet, a field bet, or a "Big 6" bet.

The concurrent wagers make the traditional craps wager 58 much more attractive to players. Many players refuse to play certain traditional craps wagers, such as many proposition bets, because the odds greatly favor the host. However, with the added attraction of a potential jackpot, many players will make wagers despite the advantage to the host. Thus, the concurrent wagers will increase the entertainment value and increase the play of traditional craps wagers.

Also, the host percent advantage on many traditional craps wagers, such as many proposition bets, is high. In addition, the odds of players actually winning the jackpot are very low. Therefore, the host may profitably provide a jackpot in connection with the traditional craps wager. Although it may pay a few jackpots, the host may realize increased revenue to cover these jackpots from the increased play on the jackpot wagering area 20.

The craps game of the present invention may be played on a video screen. Presently, craps games are available for personal home computers. In these games, the dice are rolled electronically and the outcomes of wagers are displayed on the video screen. A computer tracks wagers won and lost.

These games could easily be modified to include the jackpot sequence wager of the present invention. In addition, all embodiments and features of the present invention may easily be displayed on a video screen. For example, as seen in FIG. 1, the display 24 may be a video screen that displays a number to be rolled. Alternatively, the features of the craps layout 2 and wall 8 may be represented on a video screen. Just as a traditional craps game may be played on a video screen, the craps game of the present invention may be played on a video screen.

Therefore, the present method of playing craps may be played as a video game in a casino and allow actual betting. Alternatively, the present method of playing craps may be played as simply a recreational video game with simulated betting. A recreational video craps game could be played on a personal home computer, a video game console, or a hand-held video game. All formats for playing a craps game may incorporate the jackpot wagers of the present invention.

The disclosed wagering odds and suggested jackpots in this specification and accompanying drawings are presented for illustrative purposes only. Actual wagering odds and jackpots for particular wagers may be calculated at the host's discretion within the limits of applicable federal, state, and local laws.

I contemplate several modifications that may be made to the disclosed embodiments of the present invention that fall within the scope of the present invention. The jackpot sequence wagers, lower payoff sequence wagers, traditional craps wagers, and combinations thereof disclosed in this specification and drawings are illustrative only. Many alterations, variations, and combinations are possible that fall within the scope of the present invention. Although preferred embodiments of the present invention have been described, those skilled in the art will recognize other modifications that may be made that would nonetheless fall within the teachings of the present invention. Therefore, the present invention should not be limited to the game described. Instead, the scope of the present invention should be consistent with the invention claimed below.

I claim:

1. A method of playing a craps game comprising the steps of:

a) providing a pair of dice each having six faces bearing a visual representation of the numbers one through six, the dice being used to randomly generate a plurality of single roll dice outcomes calculated by adding a number from each die, the single roll dice outcomes including a plurality of point numbers and the number 7;

b) providing a pass line wagering area on a craps game layout;

c) providing a jackpot wagering area;

d) receiving a pass line wager in the pass line wagering area, the pass line wager being won when one or more rolls of the dice yield an established point number prior to rolling the number 7;

e) receiving a jackpot sequence wager in the jackpot wagering area; the jackpot sequence wager being won when a jackpot sequence of dice outcomes is rolled, the jackpot sequence of dice outcomes having a relatively remote probability of occurrence compared to a single roll dice outcome;

f) rolling the dice to generate a number from 2 to 12;

g) determining if the pass line wager and jackpot sequence wager are won or lost based on the roll of the dice;

h) paying a pass line wager if it is won;

i) collecting a pass line wager if it is lost;

j) paying the jackpot sequence wager if it is won;

k) collecting the jackpot sequence wager if it is lost.

2. The method of claim 1, wherein the jackpot sequence of dice outcomes is predetermined.

3. The method of claim 1, wherein the jackpot sequence of dice outcomes is randomly generated.

4. The method of claim 3, wherein the jackpot sequence of dice outcomes is randomly generated by a computer.

5. The method of claim 3, wherein the jackpot sequence of dice outcomes is randomly generated by a die.

6. The method of claim 5, wherein the jackpot sequence of dice outcomes is randomly generated by a die and an enclosure for rolling the die.

7. The method of claim 3, wherein the jackpot sequence of dice outcomes is randomly generated by a spinning, segmented wheel.

8. The method of claim 1, wherein the jackpot sequence of dice outcomes is partially predetermined and partially randomly generated.

9. The method of claim 1, further including the step of showing a number to be rolled to progress toward winning the jackpot sequence wager on a display.

10. The method of claim 9, wherein the display is incorporated in the craps game layout.

11. The method of claim 9, wherein the display is a video screen.

12. The method of claim 1, further including the step of showing progress toward winning the jackpot sequence wager with an indicator.

13. The method of claim 12, wherein the indicator is incorporated in the craps game layout.

14. The method of claim 12, wherein the indicator is shown on a video screen.

15. The method of claim 1, further including the step of showing a jackpot that may be won on a jackpot display.

16. The method of claim 15, wherein the jackpot display is incorporated in the craps game layout.

17. The method of claim 15, wherein the jackpot display is a video screen.

18. The method of claim 1, wherein the jackpot wagering area is incorporated in the craps game layout.

19. The method of claim 1, wherein the craps game layout and the dice are visually represented on a video screen.

20. A method of playing a craps game comprising the steps of:

a) providing a pair of dice each having six faces bearing a visual representation of the numbers one through six, the dice being used to randomly generate a plurality of single roll dice outcomes calculated by adding a number from each die, the single roll dice outcomes including a plurality of point numbers and the number 7;

b) providing a pass line wagering area on a craps game layout;

c) providing a jackpot wagering area;

d) receiving a pass line wager in the pass line wagering area, the pass line wager being won when one or more rolls of the dice yield an established point number prior to rolling the number 7;

e) receiving a plurality of jackpot area wagers in the jackpot wagering area, the jackpot area wagers including a first jackpot sequence wager; the jackpot sequence wager being won when a first jackpot sequence of dice outcomes is rolled, the first jackpot sequence having a relatively remote probability of occurrence compared to a single roll dice outcome;

f) rolling the dice to generate a number from 2 to 12;

g) determining if the pass line wager and jackpot sequence wager are won or lost based on the roll of the dice;

h) paying a pass line wager if it is won;

i) collecting a pass line wager if it is lost;

j) paying the jackpot sequence wager if it is won;

k) collecting the jackpot sequence wager if it is lost.

21. The method of claim 20, wherein the first jackpot sequence wager is played repetitively.

22. The method of claim 20, wherein the jackpot area wagers further include a second jackpot sequence wager that a second jackpot sequence of dice outcomes is rolled, the second jackpot sequence having a relatively remote probability of occurrence.

23. The method of claim 22, wherein the first and second jackpot sequence wagers are played consecutively.

24. The method of claim 23, wherein the first jackpot sequence wager must be won to qualify for the second jackpot sequence wager.

25. The method of claim 24, wherein the second jackpot sequence wager has a higher payoff than the first jackpot sequence wager.

26. The method of claim 24, wherein the first and second jackpot sequence wagers are played concurrently.

27. The method of claim 26, wherein the first and second jackpot sequence wagers are mutually exclusive.

28. The method of claim 28, wherein the jackpot area wagers further include a low payoff sequence wager that a low payoff sequence of dice outcomes is rolled, the low payoff sequence having a relatively higher probability of occurrence.

29. The method of claim 28, wherein the low payoff sequence wager and the first jackpot sequence wager are played consecutively.

30. The method of claim 29, wherein the low payoff sequence wager must be won to qualify for the first jackpot sequence wager.

31. The method of claim 28, wherein the low payoff sequence wager and the first jackpot sequence wager are played concurrently.

32. The method of claim 20, wherein the jackpot area wagers further include a traditional craps wager.

33. The method of claim 32, wherein the traditional craps wager and the first jackpot sequence wager are played consecutively.

34. The method of claim 33, wherein the traditional craps wager must be won to qualify for the first jackpot sequence wager.

35. The method of claim 32, wherein the traditional craps wager and the first jackpot sequence wager are played concurrently.

36. The method of claim 20, wherein all jackpot area wagers are predetermined.

37. The method of claim 20, wherein all jackpot area wagers are randomly determined.

38. The method of claim 20, wherein all jackpot area wagers are partially predetermined and partially randomly determined.

39. The method of claim 20, wherein at least one jackpot area wager is predetermined and at least one jackpot area wager is randomly determined.

40. The method of claim 20, wherein at least one jackpot area wager is predetermined and at least one jackpot area wager is partially predetermined and partially randomly determined.

41. The method of claim 20, wherein at least one jackpot area wager is randomly determined and at least one jackpot area wager is partially predetermined and partially randomly determined.

42. The method of claim 20, further including the steps of: showing a number to be rolled to progress toward winning the first jackpot sequence wager on a first display; and showing a number to be rolled to progress toward winning the second jackpot sequence wager on a second display.

43. The method of claim 42, wherein the first display and the second display are a video screen.

44. The method of claim 20, further including the steps of: showing progress toward winning the first jackpot sequence wager with a first indicator; and showing progress toward winning the second jackpot sequence wager with a second indicator.

45. The method of claim 44, wherein the first indicator and the second indicator are shown on a video screen.

46. The method of claim 20, further including the steps of: showing a first jackpot that may be won on a first jackpot display; and showing a second jackpot that may be won on a second jackpot display.

47. The method of claim 46, wherein the first jackpot display and the second jackpot display are a video screen.

48. A method of playing a craps game comprising the steps of:

a) receiving a pass line wager;

b) indicating the pass line wager on a video screen, c) receiving a jackpot sequence wager;

d) indicating the jackpot sequence wager on the video screen;

e) randomly generating a simulated single roll dice outcome, the single roll dice outcome being a number from 2 to 12 having a probability distribution equivalent to the roll of a pair of six-sided dice, the single roll dice outcomes including a plurality of point numbers and the number 7;

f) indicating the simulated single roll dice outcome on the video screen;

g) determining if the pass line wager is won or lost, the pass line wager being won when one or more simulated single roll dice outcomes yield an established point number prior to rolling the number 7;

h) determining if the jackpot sequence wager is won or lost, the jackpot sequence wager being won when a jackpot sequence of simulated single roll dice outcomes is rolled, the jackpot sequence having a relatively remote probability of occurrence compared to a single roll dice outcome;

i) indicating if the pass line wager and jackpot sequence wager are won or lost on the video screen.

* * * * *